US007690089B2

(12) United States Patent
Keyaki et al.

(10) Patent No.: US 7,690,089 B2
(45) Date of Patent: Apr. 6, 2010

(54) REVERSE OPENING TYPE SLIDE FASTENER

(75) Inventors: Keiichi Keyaki, Kurobe (JP); Takanori Ozawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/242,295

(22) Filed: Sep. 30, 2008

(65) Prior Publication Data

US 2009/0094805 A1 Apr. 16, 2009

(30) Foreign Application Priority Data

Oct. 15, 2007 (JP) ..... 2007-268150

(51) Int. Cl.
*A44B 19/38* (2006.01)

(52) U.S. Cl. ..... 24/386; 24/433

(58) Field of Classification Search ..... 24/386, 24/433, 434, 436

See application file for complete search history.

(56) References Cited

U.S. PATENT DOCUMENTS 2,157,381 A 5/1939 Carlile 4,152,813 A * 5/1979 Heimberger ..... 24/434

FOREIGN PATENT DOCUMENTS

EP 992201 A1 * 4/2000
JP 2005-245859 9/2005

* cited by examiner

*Primary Examiner*—James R Brittain
(74) *Attorney, Agent, or Firm*—Darby & Darby PC

(57) ABSTRACT

The reverse opening type slide fastener has a separable bottom end stop including upper and lower sliders, wherein a stopper for preventing the lower slider from slipping off is provided at the bottom end of a box pin. A first engaging portion is formed on an opposite side edge opposite to an insert pin of the box pin and a second engaging portion is formed on an opposite side edge opposite to the box pin of the insert pin to position the insert pin in a downward direction when the second engaging portion engages the first engaging portion. A projecting portion which makes contact with the inner face of the blade of the upper slider to suppress a free sliding of the upper slider, is formed on at least any one of front and rear side faces opposite to the inner face of the blade of the upper slider of the box pin.

4 Claims, 7 Drawing Sheets

REVERSE OPENING TYPE SLIDE FASTENER

CROSS REFERENCE TO RELATED APPLICATIONS

The present application claims priority under 35 U.S.C. §119 to Japanese Patent Application No. 2007-268150, filed Oct. 15, 2007, the content of this application is incorporated herein by reference in its entirety.

BACKGROUND OF THE INVENTION

1. Field of the Invention

The present invention relates to a reverse opening type slide fastener which can be opened upward and in a reverse direction while it is separable and engageable.

2. Background of the Invention

As a slide fastener for opening or closing right and left front bodies of clothes, a separable/engageable type slide fastener having a box pin and an insert pin on the bottom of element rows has been used.

In an ordinary slide fastener having the separable bottom end stop, the insert pin is formed at the bottom end of an element row on one side, while a box into which the insert pin is to be inserted is provided fixedly via a box pin and consecutively from the bottom end of the element row on the other side. Such a slide fastener having the separable bottom end stop is so configured that when a slider is lowered to the lowest position where the slider makes contact with the box, the insert pin can be removed from or inserted into the box and slider, so that right and left fastener stringers can be separated.

U.S. Pat. No. 2,157,381 has described an invention about the ordinary separable bottom end stop for the slide fastener, aiming at suppressing a free sliding of its slider over elements when the insert pin is removed from the slider.

The separable bottom end stop described in U.S. Pat. No. 2,157,381 has a box pin at the bottom end of an element row of a first fastener stringer while a box into which the insert pin provided consecutively from the bottom end of the element row of a second fastener stringer is to be inserted is fixed to the same box pin. The element row of the first fastener stringer has a single slider, which renders the right and left element rows of the slide fastener into a coupling state or in a separated state when the slider is slid passing over the both element rows.

The box pin of the separable bottom end stop described in U.S. Pat. No. 2,157,381 has a projection for suppressing the free sliding of the slider on each of both front and rear side faces opposite to a flange inner face of the slider when the projection engages a recess portion (notch) formed in the flange inner face of the slider.

When a wearer couples both fastener stringers from a state in which they are separate, sometimes, the wearer bends a bottom portion of the element row forward as seen from the wearer in order to facilitate an insertion action for the insert pin into an opening of the slider, so that the bottom portion is lifted up to a position where it is visible easily from the wearer and then, inserts the insert pin into the opening of the slider. Particularly, this method is often applied if the separable bottom end stop is attached to the bottom end of long clothes such that its bottom end is extended to the vicinity of his or her foot.

When the bottom end of the element row is lifted up in a forward bent state, the up-down relation of the slide fastener is reversed at the bottom end thereof, so that the box is located up while the slider is located down. Consequently, the slider may go down in a direction of separating from the box pin due to its gravity. If the slider leaves the box pin, the insert pin which the wearer attempts to insert interferes with the element row leading to the box pin, thereby producing such an inconvenience that the insert pin cannot be inserted. According to a slide fastener described in U.S. Pat. No. 2,157,381, a projection formed on the front and rear side faces of the box pin engages a recess portion formed in the flange inner face of the slider, so as to prevent the slider from separating from the box.

Japanese Patent Application Laid-Open publication No. 2005-245859 has proposed a separable bottom end stop for reverse opening type slide fastener which can be opened in both ways from upward and downward by disposing two sliders such that their rear mouths are opposite to each other.

The reverse opening type slide fastener described in Japanese Patent Application Laid-Open publication No. 2005-245859 has an upper slider and a lower slider which enable the slider to be opened/closed in both ways from upward and downward, and the insert pin which can be removed from and inserted into the upper slider and the lower slider is attached on the bottom end of the element row on one side such that the rear mouths of the upper slider and the lower slider keep contact with each other in the opposite state. Further, a box pin in which an escape preventing stopper is formed in order to lock the lower slider at a lowest position is mounted on the bottom end of the element row on the other side.

An operation of the reverse opening type slide fastener having a separable bottom end stop described in Japanese Patent Application Laid-Open publication No. 2005-245859 in case where the slide fastener is used for opening/closing the right and left front bodies of clothes will be described. If the upper slider is slid downward with right and left fastener stringers completely coupled with each other, the right and left front bodies of clothes can be opened at the top. Further, if the lower slider is slid from down to up together with the upper slider with the slide fastener opened, the right and left front bodies can be opened at the bottom.

When the wearer takes off clothes, the rear mouths of the upper slider and the lower slider are brought into contact with each other in an opposite state and then, lowered to the lowest position. Then, an operation of removing the insert pin attached on the bottom end of the element row from the upper slider and the lower slider is carried out. Consequently, the right and left fastener stringers are separated, so that the right and left front bodies of clothes are separated and the clothes are easy to take off.

To remove the insert pin from the upper slider and the lower slider, the right and left element rows need to be completely kept uncoupled. For that purpose, with the rear mouths of the upper slider and the lower slider kept into contact in the opposite state, the rear mouths need to be kept lowered to the bottom end of the fastener stringer.

When the wearer puts on clothes, the insert pin needs to be inserted into the opening in the upper slider and the lower slider in order to couple separated right and left element rows with each other. In this case, unless the rear mouths of the upper slider and the lower slider are kept in contact with each other in the opposite state and kept lowered to the bottom end of the fastener stringer, the inserted insert pin interferes with the element row, thereby making difficult the insertion of the insert pin.

Further, when the wearer attempts to insert the insert pin with the lower portion of the element row bent forward as seen from the wearer so that the lower portion is lifted up to a position where it can be seen easily by the wearer, the upper slider independently or both the upper and lower sliders may be lowered in a direction of separating from the box pin due to the gravity in many cases. Particularly, if the upper slider leaves the box pin in a separated state, the stringer is bent between the respective sliders. In this case, when the wearer attempts to insert the insert pin, the insert pin cannot be inserted all at once. Consequently, the sliders interfere with the element rows consecutive from the box pin, thereby producing such an inconvenience of complicating the inserting operation for the insert pin.

SUMMARY OF THE INVENTION

Accordingly, the present invention has been accomplished to solve the problems possessed by the prior art and an object of the invention is to provide a reverse opening type slide fastener which can be opened in a reverse direction and separated and brought into an engagement such that rear mouths of an upper slider keep contact with each other in the opposite state. In the slider fastener, even if an insert pin is removed from the upper slider and the lower slider, the upper slider and the lower slider can be held at the bottom end of the box pin.

To achieve the above-described object, the present invention provides a reverse opening type slide fastener having a separable bottom end stop including: a box pin provided consecutively from a bottom end of a first element row disposed on a side edge of a first fastener stringer; an insert pin provided consecutively from a bottom end of a second element row disposed on a side edge of a second fastener stringer; and an upper slider which enables the slide fastener to be opened upward and a lower slider which enables the slide fastener to be opened in a reverse direction, with rear mouths thereof opposite to each other. The reverse opening type slide fastener includes: a stopper for preventing the lower slider from slipping off, provided at an end portion on an opposite side to the first element row of the box pin; a first engaging portion provided on an opposite side edge opposite to the insert pin of the box pin; and a second engaging portion which engages the first engaging portion so as to position the insert pin in a downward direction, provided on an opposite side edge opposite to the box pin of the insert pin, wherein the upper slider and the lower slider includes front and rear blades which form each element row guide passage which allows the first element row and the second element row to pass therethrough. The reverse opening type slide fastener further includes a projecting portion which makes contact with any one of inner faces of the front and rear blades so as to suppress a free sliding of the upper slider on at least any one of a front side face and a rear side face opposite to any one of the inner faces of the front and rear blades of the upper slider of the box pin.

As the projecting portions, preferably, a plurality of the projecting portions of at least one kind of oval type, truncated cone type and cylindrical type are disposed.

Further, preferably, an inside height between an inner face of the front blade and an inner face of the rear blade of the lower slider is set larger than an inside height between the inner face of the front blade and the inner face of the rear blade of the upper slider.

Preferably, the projecting portion which makes contact with any one of the inner faces of the blades of the lower slider so as to suppress a free sliding of the lower slider is formed on at least any one of a front side face and a rear side face opposite to any one of the inner faces of the blades of the lower slider of the box pin.

According to the present invention, the projecting portion is formed on at least any one of the front side face and the rear side face of the box pin of the reverse opening type slide fastener. Consequently, the free sliding of the upper slider can be suppressed by keeping the inner face of the upper slider and the projecting portion in contact with each other in a state that the upper slider and the lower slider are lowered to the bottom end of the box pin with the rear mouths thereof kept in contact with each other. Thus, even in a state that the insert pin is pulled out of the upper slider and the lower slider and separated therefrom, the upper slider and the lower slider can be held at the bottom end of the box pin, so that an inserting operation for the insert pin is facilitated.

Further, a plurality of the projecting portions (each having a small contact area) are disposed such that, a friction force generated between the projecting portion and the inner face of the blade can be maintained within a predetermined range even if the interval between the projecting portion and the inner face of the blade is not uniform. For example, in the box pin in which the projecting portions are formed on the front side face and the rear side face, a core thread of the slide fastener is pressurized using the front and rear side faces and fixed such that the core thread is sandwiched by the box pin. Because a thickness between the projecting portions of the front side face and the rear side face of the box pin after the core thread is pressurized is not uniform, the range of a tolerable dimension of an interval between the projecting portion and the inner face of the blade of the slider needs to be designed wide. For this reason, the height of the projecting portion is intensified so as to secure a contact with the inner face of the blade of the slider to ensure a holding force for the slider. By reducing the area of the projecting portion, the friction force generated upon sliding the slider can be prevented from being increased too much even if a pressing force between the projecting portion and the inner face of the blade of the slider is strong.

By setting the interval between the inner faces of the front and rear blades of the upper slider larger than the interval between the inner faces of the front and rear blades of the lower slider, the holding force between the lower slider and the box pin can be eliminated so as to reduce a starting resistance upon sliding the lower slider upward from the bottom end, thereby improving the operability.

Further, by forming the projecting portion which makes contact with the inner face of the lower slider blade so as to limit a free sliding of the lower slider on at least any one of the front side face and the rear side face opposite to the inner face of the front and rear blades of the lower slider of the box pin, the upper slider and the lower slider can be held at the bottom end of the box pin securely, so that the inserting operation for the insert pin is facilitated.

DESCRIPTION OF THE INVENTION

Hereinafter, the typical embodiments of the reverse opening type slide fastener according to the present invention will be described in detail with reference to the accompanying drawings.

Figure 1:
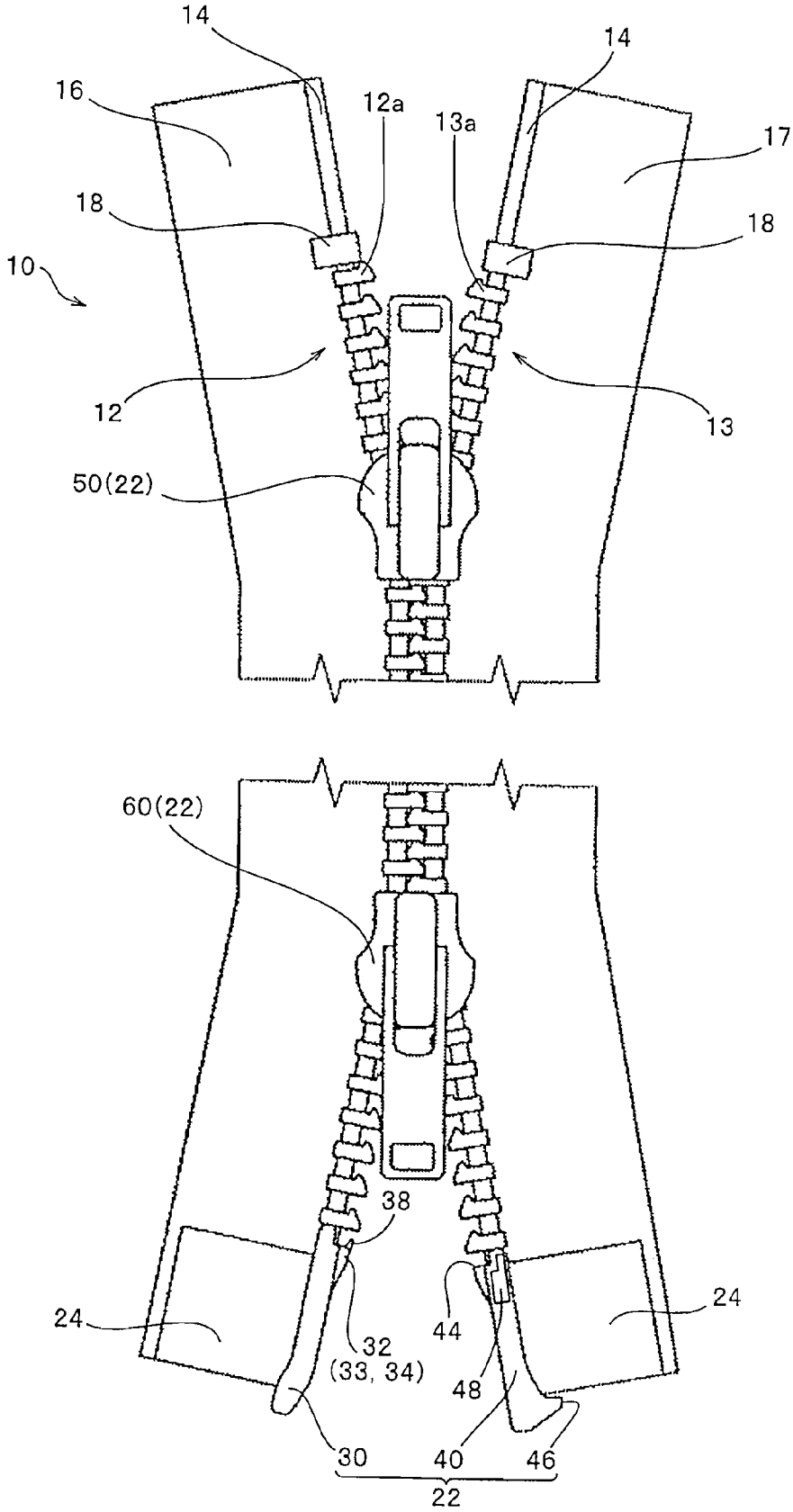
FIG. 1 is a front view of an appearance of a reverse opening type slide fastener with representation of part thereof omitted.
Figure 2:
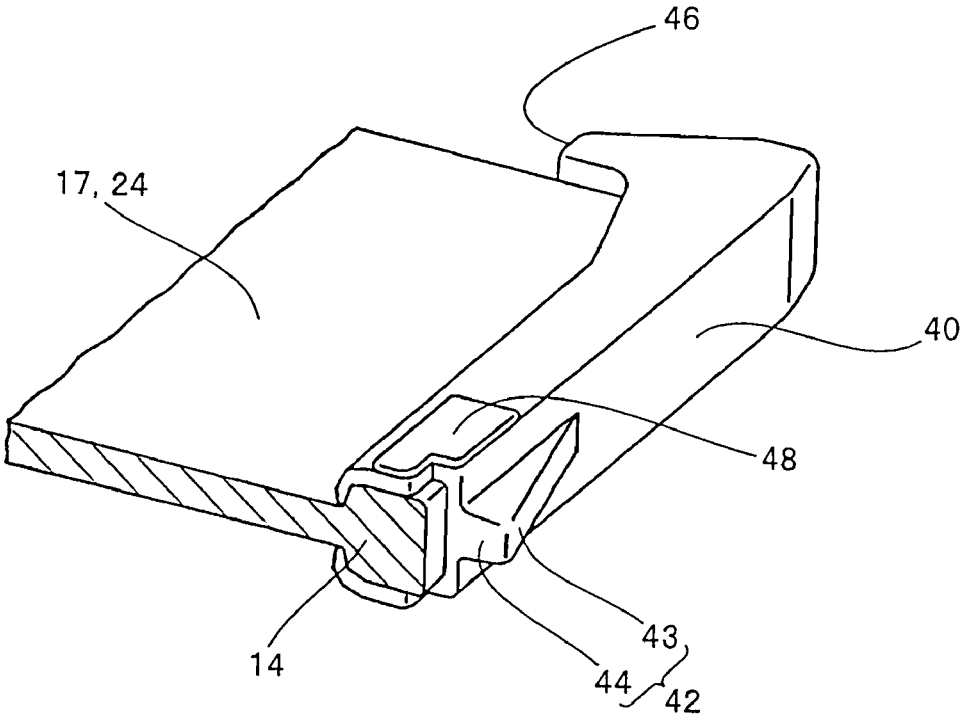
FIG. 2 is a sectional perspective view of a bottom end of a right fastener stringer with which a box pin is provided consecutively.
Figure 3:
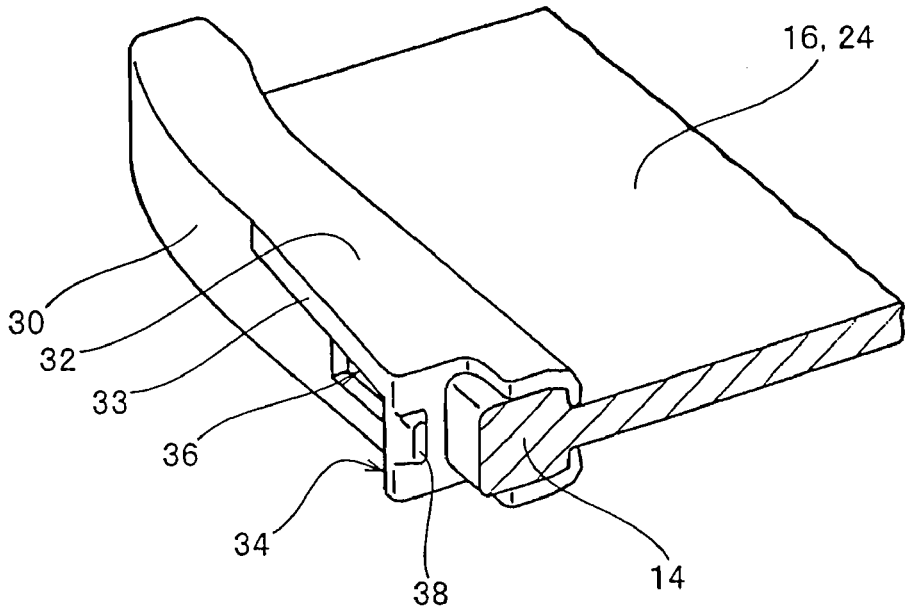
FIG. 3 is a sectional perspective view of a bottom end of a left fastener stringer with which an insert pin is provided consecutively.

FIG. 1 is an appearance view of an entire reverse opening type slide fastener 10 or a front view showing a state in which an upper slider 50 is lowered slightly downward from a contact position of top end stops 18, 18 while a lower slider 60 is raised slightly from an insertion position of an insert pin 30 and a box pin 40 which are separable bottom end stops. FIG. 2 is a partial perspective view showing a portion adjacent to a box pin mounting end of a right fastener stringer 17 (first fastener stringer) having the box pin 40 provided consecutively in a cutaway state, and FIG. 3 is a partial perspective view showing a portion adjacent to an insert pin attaching end of a left fastener stringer 16 (second fastener stringer) having the insert pin 30 provided consecutively in a cutaway state.

As shown in FIG. 1, the reverse opening type slide fastener 10 is an opening/closing device which can open or close a left front body and a right front body of, for example, a long coat. The reverse opening type slide fastener includes a left fastener stringer 16, a right fastener stringer 17, right and left core threads 14 disposed along opposite side edges of the left fastener stringer 16 and the right fastener stringer 17, and left element row 12 (second element row) and right element row 13 (first element row) in which a number of the elements 12*a*, 13*a* are disposed in line at a predetermined interval so as to nip each core thread 14.

Further, the reverse opening type slide fastener 10 includes an upper slider 50 which allows the left element row 12 and the right element row 13 to pass therethrough so as to enable the slide fastener to be opened upward and a lower slider 60 which enables the slide fastener to be opened in a reverse direction. A rear mouth of the upper slider 50 and a rear mouth of the lower slider 60 are disposed such that the rear mouths are opposite to each other. A top end stop 18 is fixed to each of the core thread 14 portion located at upper portions of the left element row 12 and the right element row 13 in order to prevent the upper slider 50 from slipping out of the left element row 12 and the right element row 13. The present invention can be applied to a concealed type slide fastener which can be opened in a reverse direction.

A reinforcement film 24 made of resin film or the like is bonded to the front and rear sides of the bottom end of the right fastener stringer 17 as shown in FIGS. 1 and 2. The box pin 40 is provided consecutively such that the box pin sandwiches both the reinforcement films 24 and the core thread 14.

A hook-shaped stopper 46 is formed at an end portion of the bottom end of the box pin 40 and when the lower slider 60 is lowered to the lowest position, the hook-shaped stopper 46 makes contact with a shoulder mouth portion of the lower slider 60 so as to prevent the lower slider 60 from slipping out downward. According to the embodiment shown in FIGS. 1 and 2, the stopper 46 is projected from the bottom end of the box pin 40 in an outward direction which is an opposite direction to a coupling axis line so as to engage the shoulder mouth of the lower slider 60. The shape of the stopper 46 according to the present invention is not restricted to the shape of the stopper 46 shown in FIGS. 1 and 2, but the stopper may be projected from the bottom end portion of the box pin in a direction to the front face or the rear face of the slide fastener so that the stopper makes contact with an end face of a front blade 52 or a rear blade 54 of the lower slider, thereby preventing the lower slider from slipping out downward.

An opposite side face of the box pin 40 which is opposite to the insert pin 30 has a triangular piece like first engagement guide piece 42 including a first engaging portion 44 composed of a plane directed to a side where a right element row 13 exists and a guide face 43 which guides a connecting post 66 (see FIGS. 4 to 6) formed inside the lower slider 60 so as to facilitate uncoupling between the left element row 12 and the right element row 13. The first engaging portion 44 engages a second engaging portion 34 of the insert pin 30 described later.

The front side face of the box pin 40 which is opposite to an flat inside face of a front blade 52 (see FIG. 7) of the upper slider 50 at an upper portion of the box pin 40 has a projecting portion 48 which is a characteristic portion of the present invention, making contact with the inside face of the front blade 52 of the upper slider 50 so as to suppress a free sliding of the upper slider 50 in a state that the upper slider 50 is lowered to the lowest position.

As shown in FIGS. 1 and 3, the reinforcement film 24 made of resin film or the like is bonded to the front and rear sides of the bottom end of the left fastener stringer 16. The insert pin 30 is provided consecutively so as to nip the reinforcement film 24 and the core thread 14.

A flat second engaging portion 34 whose engaging face is directed downward (deep side direction of FIG. 2) is formed on an opposite side face of the insert pin 30 which is opposite to the box pin 40. When the box pin 20 and the insert pin 30 are inserted into the lower slider 60, the second engaging portion 34 engages a first engaging portion 44 of the box pin 40 described above. A second engagement guide piece 32 having a guide face 33 which is guided by the connecting post 66 (see FIGS. 4 to 6) inside the lower slider 60 is erected from an edge on the opposite side to the box pin of the second engaging portion 34 such that the second engagement guide piece is curved from the second engaging portion 34 and extended downward. In the meantime, the second engagement guide piece 32 plays a role of reinforcing the second engaging portion 34 erected from the insert pin 30.

A clearance groove 36 for avoiding an interference of the first engaging portion 44 projecting from the opposite side edge of the box pin 40 is made in a portion surrounded by the second engagement guide piece 32 and the second engaging portion 34 of the opposite side face which is opposite to the box pin 40. A coupling projection 38 which couples with a valley portion of a coupling head of an element 13*a* located at the lowest position of the right element row 13 is formed above the second engaging portion 34 on the left element row 12 side.

Next, a state in which the lower slider 60 is lowered to the lowest position from the state shown in FIG. 1 will be described using a sectional view shown in FIG. 4.

Figure 4:
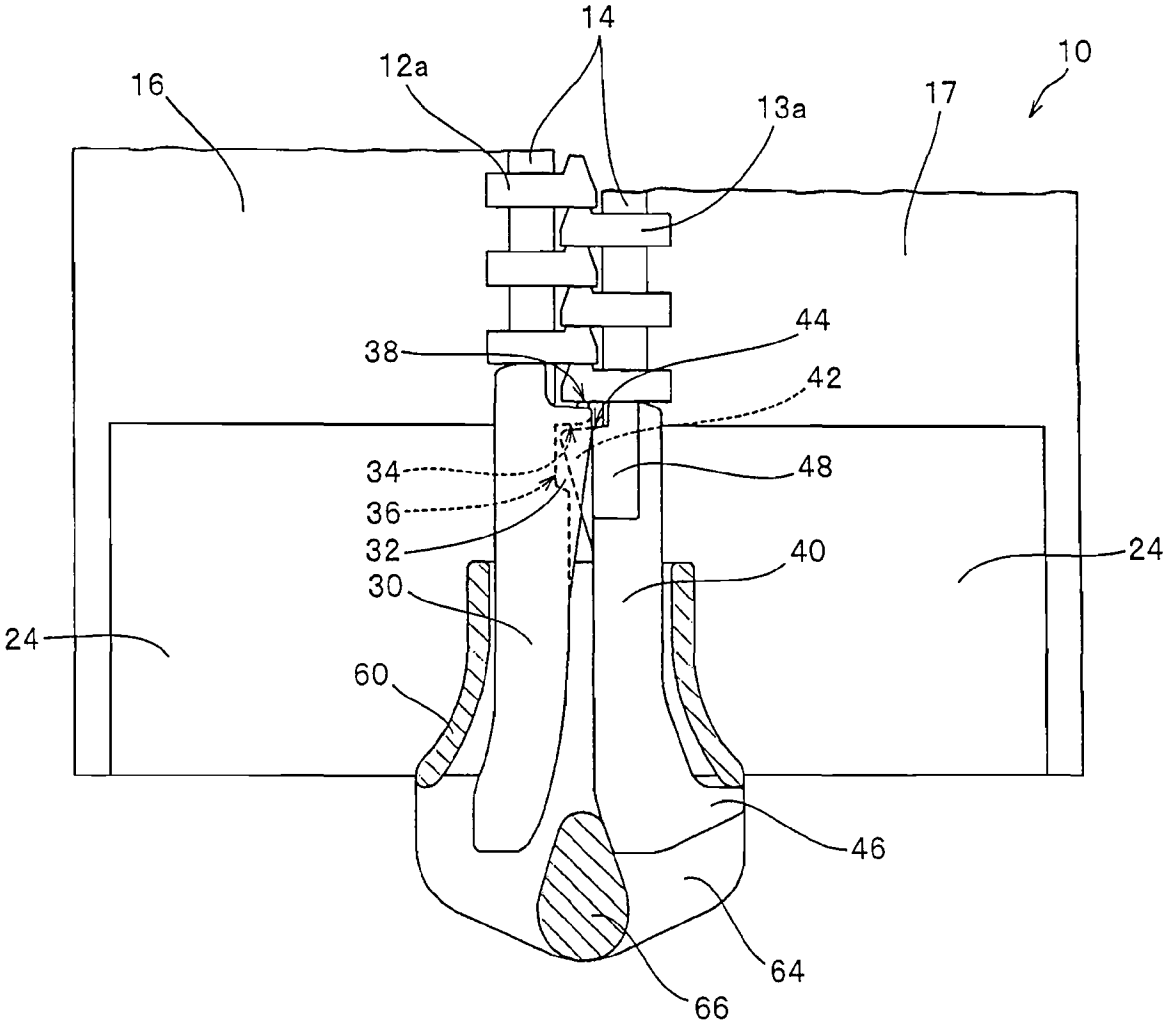
FIG. 4 is a sectional view taken along the line IV-IV of FIG. 7 when only a lower slider is lowered to the lowest position.
Figure 7:
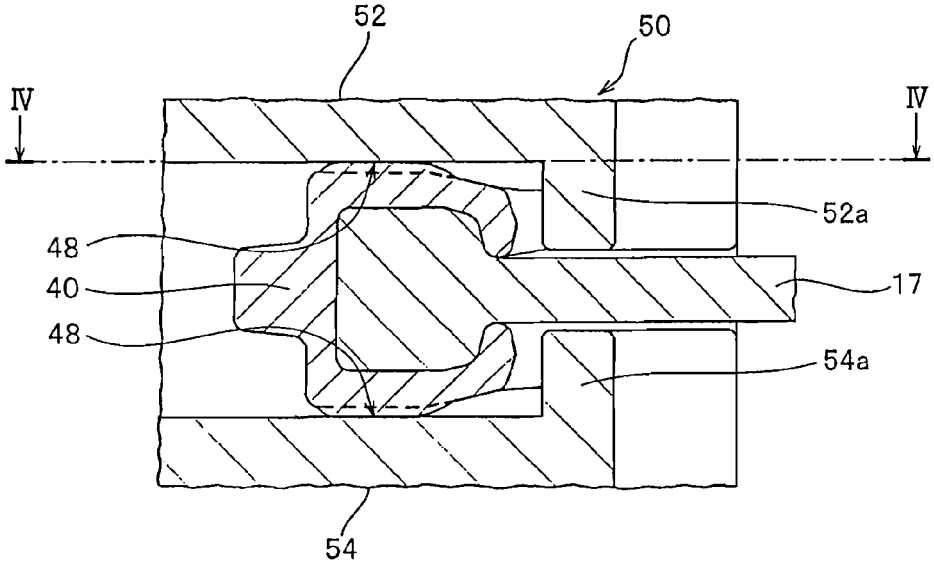
FIG. 7 is an explanatory diagram for explaining the structure and function of a projecting portion formed on the front side face and the rear side face of the box pin.

FIG. 4 is a view showing a state in which only the lower slider 60 of the reverse opening type slide fastener 10 is lowered to the lowest position or a sectional view taken along the line IV-IV of FIG. 7.

The lower slider 60 and the upper slider 50 have an element guide passage which penetrates each of the respective sliders 50, 60 in a front-back direction internally. The element guide passage has a shoulder mouth provided on a front end side and a rear mouth provided on a rear end side of the slider. The shoulder mouth introduces separated right and left elements into the element guide passage and discharges the elements out, and the rear mouth introduces coupled right and left elements into the element guide passage and discharges the elements out.

When the lower slider 60 is lowered, the right and left coupling rows 12, 13 in a separated state are coupled with each other and discharged in the coupled state. If the lower slider 60 is lowered further, the box pin 40 and the insert pin 30 are inserted from the shoulder mouth of the lower slider 60 and the stopper 46 formed at the end portion of the bottom end of the box pin 40 comes into contact with the shoulder portion of the lower slider 60 so that the slider is stopped. This position is the lowest position of the lower slider 60.

With this state, the left element row 12 and the right element row 13 are coupled with each other at a portion between the rear mouth of the lower slider 60 and the rear mouth of the upper slider 50. At this time, the coupling projection 38 projecting upward to the top end of the insert pin 30 is engaged with the valley portion in the bottom face of the element 13*a* located at the lowest position of the right element row 13.

The first engagement guide piece 42 projecting from the box pin 40 exists on a deep side with respect to the second engagement guide piece 32 provided on the upper portion of the insert pin 30, so that the first engagement guide piece 42 is settled in the clearance groove 36 formed in the opposite side edge portion of the insert pin 30.

Next, a state in which the upper slider 50 is lowered from the state shown in FIG. 4 will be described with reference to FIG. 5.

Figure 5:
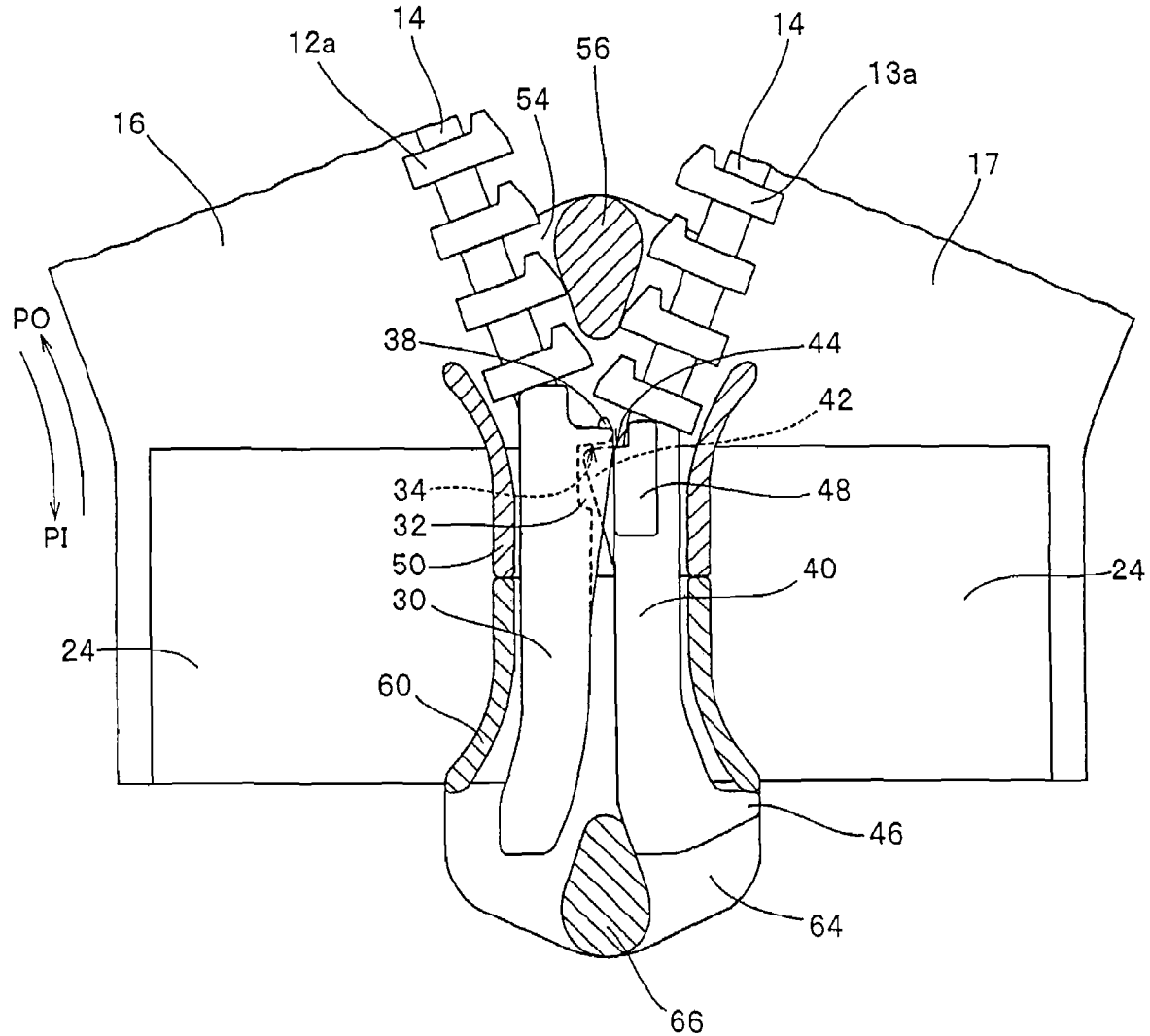
FIG. 5 is a sectional view taken along the line IV-IV of FIG. 7 when an upper slider is lowered to the lowest position where the upper slider makes contact with the lower slider.

FIG. 5 is a view showing the state in which the upper slider 50 is lowered to the lowest position where the slider contacts the lower slider 60 or a sectional view taken along the line IV-IV of FIG. 7.

When the upper slider 50 is lowered, the right and left element rows 12, 13 in a coupled state are separated and discharged from the shoulder mouth of the upper slider 50 in the separated state. Then, if the upper slider 50 is lowered further, the rear mouth of the upper slider 50 comes into contact with the rear mouth of the lower slider 60, so that the upper slider 50 is stopped. This position is the lowest position of the upper slider 50.

With this state, all elements of the left element row 12 and the right element row 13 are in the separated state. Thus, the wearer can pull out the insert pin 30 from the lower slider 60 and the upper slider 50 by gripping the reinforcement portion 24 having a relatively high stiffness at the bottom end portion of the left fastener stringer 16 and then pulling the reinforcement portion upward in a direction indicated with an arrow PO. Consequently, the right front body and the left front body of clothes are opened, so that a person can take off or put on the clothes easily.

Although the insert pin 30 can be pulled out in the direction of the arrow PO from the state shown in FIG. 5, even if the insert pin 30 is attempted to be pushed down in a direction of an arrow PI which is an opposite direction with respect to the upper and lower sliders 50, 60, the insert pin 30 cannot be moved downward independently from a position shown in FIG. 5 because the first engaging portion 44 of the box pin 40 comes into contact with the second engaging portion 34 of the insert pin 30.

Next, a state when the left fastener stringer 16 is raised from the state shown in FIG. 5 will be described with reference to FIG. 6.

Figure 6:
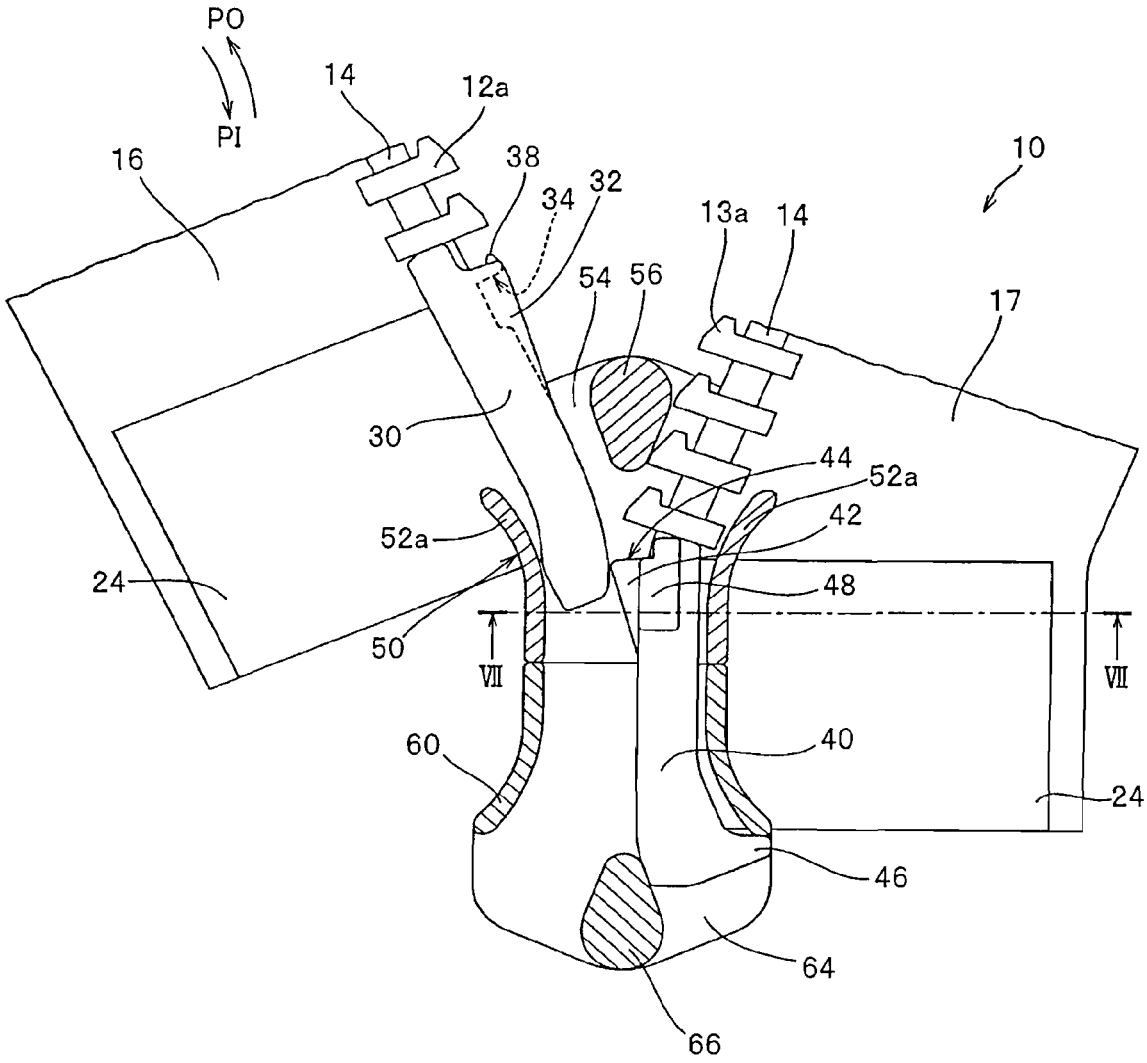
FIG. 6 is a sectional view taken along the line IV-IV when a tip of the insert pin of the left fastener stringer is inserted into a shoulder mouth portion on the left side of the upper slider.

FIG. 6 is a view showing a state in which the tip of the insert pin 30 of the left fastener stringer 16 is inserted into the shoulder mouth on the left side of the upper slider 50 or a sectional view taken along the line IV-IV of FIG. 7.

If the left fastener stringer 16 is raised up to the state shown in FIG. 6, the insert pin 30 can be removed from the upper slider 50 without any resistance in the direction of the arrow PO. If the insert pin 30 is inserted into the left shoulder mouth of the upper slider 50 from the state in which the insert pin 30 is pulled out of the upper slider 50 completely, the insert pin 30 can be inserted up to a position where the second engaging portion 34 come into contact with the first engaging portion 44 as described previously with FIG. 5 through the state shown in FIG. 6. If the upper slider 50 is pulled upward under this state, the left element row 12 and the right element row 13 couple with each other so as to close the left front body and the right front body of clothes, thereby connecting both the front bodies.

Next, the structure and function of the projecting portion 48 formed on the front side face and the rear side face of the box pin 40 will be described with reference to FIG. 7. FIG. 7 is a sectional view taken along the line VII-VII of FIG. 6. Although FIG. 7 shows an embodiment in which the projecting portion 48 is formed on each of both the front side face and the rear side face of the box pin 40, the projecting portion 48 may be formed on any one of the front side face and the rear side face of the box pin 40.

As shown in FIG. 7, the upper slider 50 has the front blade 52 on its front face side and the rear blade 54 on its rear face side. In the meantime, the front and rear blades 52, 54 are connected by a connecting post 56 (see FIGS. 4 to 6) disposed at a central portion of the both shoulder mouth portions of the upper slider 50. Front and rear flanges 52*a*, 54*a* projecting in opposite directions to each other are provided along both right and left side edges of the front and rear blades 52, 54, and a space surrounded by the front and rear blades 52, 54, the connecting post 56 and the right and left front and rear flanges 52*a*, 54*a* serves as an element guide passage. The projecting portion 48 formed on the front side face and the rear side face of the box pin 40 is configured to make contact with the flat inner face of the front blade 52 and the flat inner face of the rear blade 54 through an interference fit or medium fit. In the meantime, if the projecting portion 48 is so configured to make contact with the inner face of the front blade 52 and the inner face of the rear blade 54 through the interference fit, the box pin 40 having a C-shaped section may be formed thinly so that the projecting portion 48 is resiliently deformed easily following a height relative to the inner face of the front blade 52 and the inner face of the rear blade 54.

By keeping the projecting portions 48 in contact with the inner face of the front blade 52 and the inner face of the rear blade 54 of the upper slider 50, a free sliding of the upper slider 50 can be suppressed due to a friction force generated on this contact portion. Therefore, even when the insert pin 30 is pulled out of the upper slider 50 and the lower slider 60 so that the insert pin is separated therefrom, the upper slider 50 and the lower slider 60 can be maintained at the bottom end of the box pin 40, thereby facilitating removal operation and inserting operation for the insert pin 30.

Next, an operation of inserting the insert pin 30 into the upper slider 50 and the lower slider 60 in a case where the separable bottom end stop 22 for the reverse opening type slide fastener is applied to the bottom end of clothes whose left front body and right front body are long toward a hem thereof, its bottom end being extended to the vicinity of the foot, will be described.

It is not easy to insert the insert pin 30 into the upper slider 50 and the lower slider 60 existing in the vicinity of the foot like in this example. Thus, the bottom portion of the right fastener stringer 17 is bent forward as seen from the wearer and lifted up to a position easy for the wear to see and then, the insert pin 30 is inserted. If the bottom end of the right fastener stringer 17 is bent forward and lifted up, the up-down relation of the slide fastener is reversed at the bottom end of the reverse opening type slide fastener 10. Consequently, the lower slider 60 is located above and the upper slider 50 is located below the lower slider 60. With this configuration, there occurs such an inconvenience that the upper slider 50 independently or both the upper slider 50 and the lower slider 60 may slip off in a direction of departing from the box pin 40 due to its gravity. If the upper slider 50 departs from the box pin 40, the insert pin 30 which the wearer attempts to insert interferes with the right element row 13 on the box pin 40 side, thereby blocking the insert pin 30 from being inserted.

According to this embodiment, the projecting portion 48 is formed on the top of the box pin 40 such that the projecting portion 48 keeps contact with the inner face of the front blade 52 and the inner face of the rear blade 54 of the upper slider 50. Consequently, a free sliding of the upper slider 50 is suppressed and the lower slider 60 can be sandwiched and kept stationary between the rear mouth portion of the upper slider 50 and the stopper 46 of the box pin 40. As a result, the interference between the right element row 13 and the insert pin 30 is prevented, thereby carrying out the inserting operation for the insert pin 30 easily.

According to the present invention, no recess portion needs to be formed in the inner face of the front blade 52 and the inner face of the rear blade 54 opposite to the projecting portion 48 formed on the upper portion of the box pin 40 unlike the slider described in U.S. Pat. No. 2,157,381. As a result, the cheap upper slider 50 having a simple structure can be used and further the separable bottom end stop 22 for the reverse opening type slide fastener can be provided at a low price.

By setting an interval between the inner wall face of the front blade 54 and the inner wall face of the rear blade 64 of the lower slider 60 larger than an interval between the inner wall face of the front blade 52 and the inner wall face of the rear blade 54 of the upper slider 50, a predetermined friction force may be generated between the box pin 40 and the upper slider 50 while no friction force is generated between the box pin 40 and the lower slider 60 by eliminating any contact therebetween. This structure can suppress the free sliding of the upper slider 50 and reduce a sliding resistance when the lower slider 60 is started, thereby improving an operating feeling upon opening/closing of the slide fastener.

Next, other embodiments regarding the arrangement of the projecting portions formed on the side faces of the box pin will be described.

Figure 8:
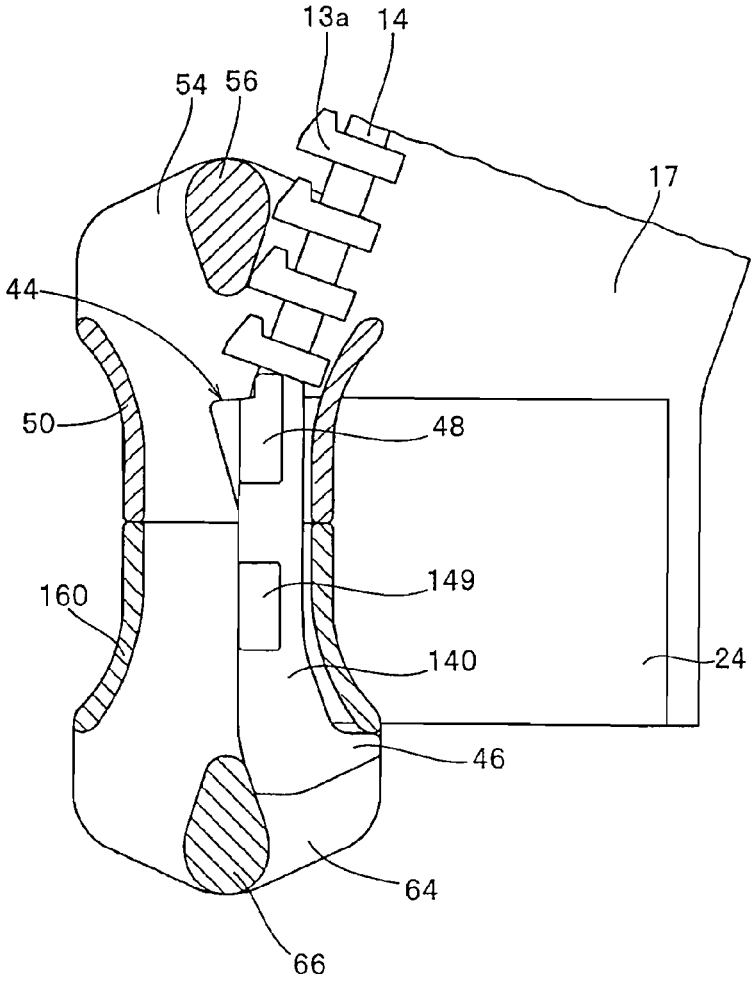
FIG. 8 is a perspective view for explaining other embodiment regarding the arrangement of the projecting portion formed on the side face of the box pin.

FIG. 8 is a sectional view showing a state in which the projecting portion 48 which is a characteristic portion of the present invention is formed on the front side face (surface side of the same Figure) of the upper portion of the box pin 140 and a projecting portion 149 is also formed on the front side face (surface side of the same Figure) of a central portion of the box pin 140. FIG. 8 is a view showing a state in which the upper slider 50 and the lower slider 160 are pulled to the lowest position thereof so as to pull out the insert pin 30 completely. In the meantime, like reference numerals are attached to parts and portions which exert like functions in FIG. 6 and description thereof is omitted.

As shown in FIG. 8, the projecting portion 48 is formed on the front side face opposite to the inner face of the front blade 52 (see FIG. 7) of the upper slider 50 at the upper portion of the box pin 140 in order to suppress the free sliding of the upper slider 50 in a state that the upper slider 50 is lowered to the lowest position because the box pin 140 makes contact with the inner face of the front blade 52 of the upper slider 50. Likewise, the projecting portion 149 is formed on the front side face opposite to the inner face of the front blade of the lower slider 160 at the central portion of the box pin 140 in order to suppress the free sliding of the lower slider 160 in a state that the lower slider 160 is lowered to the lowest position because the box pin 140 makes contact with the inner face of the front blade of the lower slider 160.

With this structure, the box pin 140 suppresses the sliding of the upper slider 50 and the lower slider 60 at two positions, the upper portion and the central portion when both the upper slider 50 and the lower slider 160 are lowered to the lowest position. Consequently, the upper slider 50 can be maintained securely at the lowest position. Therefore, even if the up-down relation of the slide fastener is reversed at the bottom end of the reverse opening type slide fastener, the operability upon inserting the insert pin 30 into the upper slider 50 and the lower slider 60 can be improved.

Third Embodiment

Next, other embodiment regarding the shape of the projecting portion formed on the side face of the box pin will be described.

Figure 9:
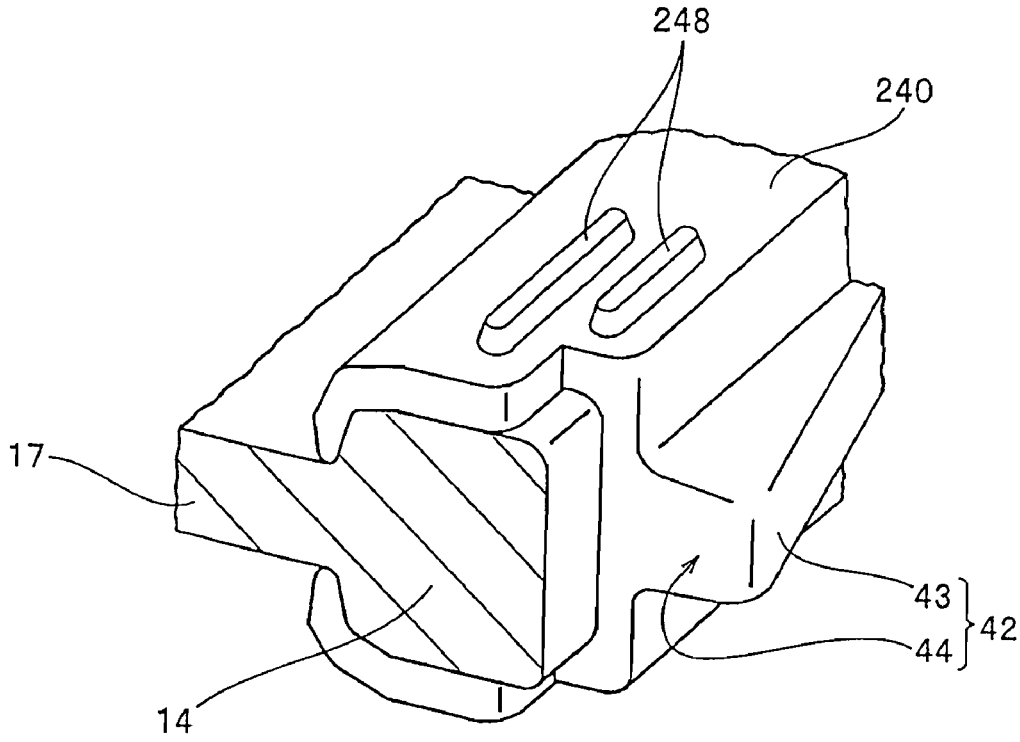
FIG. 9 is a perspective view for explaining an embodiment in which plural oval projecting portions are formed on the side face of the box pin.

FIG. 9 is a perspective view showing an embodiment in which oval projecting portions 248 are formed on front and rear side faces of an upper portion of a box pin 240. In the meantime, like reference numerals are attached to parts and portion which exert like functions in FIG. 2 and description thereof is omitted.

As shown in FIG. 9, the plural oval projecting portions 248 are formed on the front side face opposite to the inner face of the front blade 52 (see FIG. 7) of the upper slider 50 of the box pin 240 in order to suppress the free sliding of the upper slider 50 in a state that the upper slider 50 is lowered to the lowest position, because the box pin 240 makes contact with the inner face of the front blade 52 at the plural positions.

If the oval projecting portions 248 are configured on the box pin 240, the oval projecting portions 248 can make contact with at least any one inner face of the front blade 52 and the rear blade 54 of the upper slider 50 through a small area, so as to maintain the upper slider 50 at the lowest position. Thus, even if the up-down relation of the slide fastener is reversed at the bottom end of the reverse opening type slide fastener 10, the operability upon inserting the insert pin 30 into the upper slider 50 can be improved. Even if the height of the projecting portion 248 is increased so as to increase the range of a tolerable dimension of an interval between the projecting portion 248 and the front and rear inner faces of the upper slider 50, a holding force for maintaining the upper slider 50 at the lowest position can be kept within a predetermined range.

Fourth Embodiment

Next, other embodiment regarding the shape of the projecting portion formed on the side face of the box pin will be described.

Figure 10:
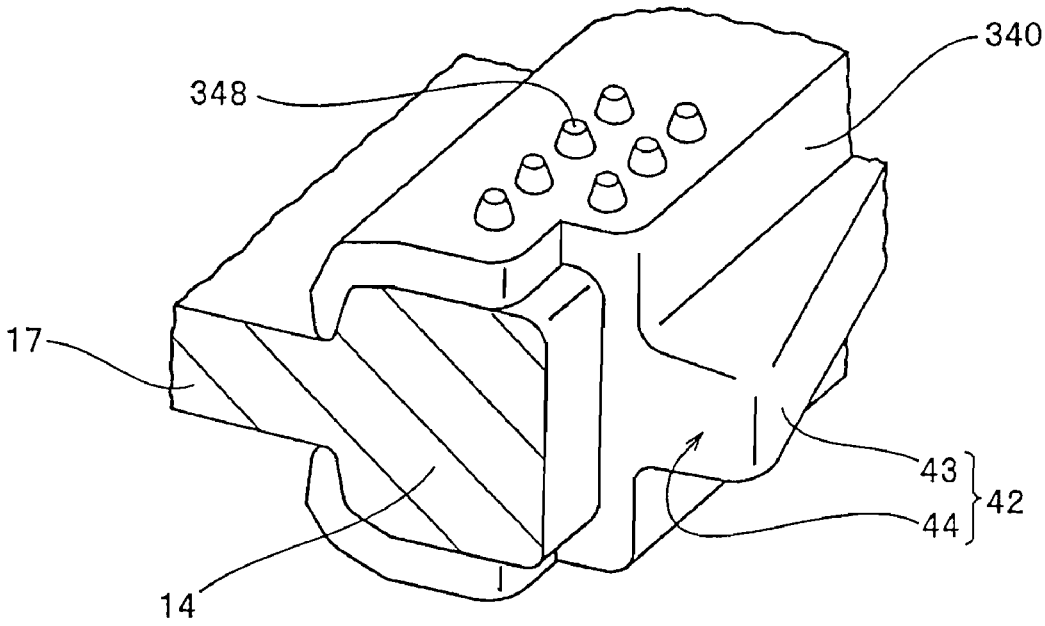
FIG. 10 is a perspective view for explaining an embodiment in which plural truncated cone projecting portions are formed on the side face of the box pin.

FIG. 10 is a perspective view showing an embodiment in which a plurality of the truncated cone shaped projecting portions 348 are formed on the side face of an upper portion of the box pin 340. In the meantime, like reference numerals are attached to parts and portions in FIG. 10 which exert like functions in FIG. 2 and description thereof is omitted.

As shown in FIG. 10, the plurality of the truncated cone shaped projecting portions 348 are formed on the front side face opposite to the inner face of the front blade 52 (see FIG. 7) of the upper slider 50 of the box pin 340 in order to suppress the free sliding of the upper slider 50 in a state that the upper slider 50 is lowered to the lowest position, because the truncated cone shaped projecting portions 348 make contact with the inner face of the front blade 52 of the upper slider 50. Cylindrical projecting portions 348 can be used in place of the truncated cone shaped projecting portions 348.

If the truncated cone shaped and/or cylindrical projecting portions 348 are configured on the box pin 340, they can make contact with at least any one inner face of the front blade 52 and the rear blade 54 of the upper slider 50 through a small contact area so as to maintain the upper slider 50 at the lowest position. Consequently, even if the up-down relation of the slide fastener is reversed by folding back the fastener at the bottom end side of the reverse opening type slide fastener, the operability upon inserting the insert pin 30 into the upper slider 50 can be improved. Further, even if the height of the projecting portion 348 is increased to increase the range of a tolerable dimension of an interval between the projecting portion 348 and the front and rear inner faces of the upper slider 50, a holding force for maintaining the upper slider 50 at the lowest position can be kept within a predetermined range.

What is claimed is:

1. A reverse-opening slide fastener having a separable bottom end stop comprising:

a box pin provided consecutively from a bottom end of a first element row disposed on a side edge of a first fastener stringer;

an insert pin provided consecutively from a bottom end of a second element row disposed on a side edge of a second fastener stringer;

an upper slider which enables the slide fastener to be opened upward and a lower slider which enables the slide fastener to be opened in a reverse direction, with rear mouths thereof opposite to each other;

a stopper for preventing the lower slider from slipping off, provided at an end portion on an opposite side to the first element row of the box pin;

a first engaging portion provided on an opposite side edge opposite to the insert pin of the box pin; and a second engaging portion which engages the first engaging portion so as to position the insert pin in a downward direction, provided on an opposite side edge opposite to the box pin of the insert pin, wherein the upper slider and the lower slider include front and rear blades which form each element row guide passage which allows the first element row and the second element row to pass therethrough, and wherein the reverse-opening slide fastener comprises a projecting portion which makes contact with an inner face of at least any one of the front and rear blades so as to suppress a free sliding of the upper slider on at least any one of a front side face and a rear side face opposite to the inner face of at least any one of the front and rear blades of the upper slider of the box pin.

2. The reverse-opening slide fastener according to claim 1, wherein a plurality of the projecting portions are disposed.

3. The reverse-opening slide fastener according to claim 1, wherein an interval between inner faces of the front and rear blades of the lower slider is set larger than an interval between the inner faces of the front and rear blades of the upper slider.

4. The reverse-opening slide fastener according to claim 1, further comprising a projecting portion which makes contact with any one of the inner faces of the front and rear blades so as to suppress a free sliding of the lower slider on at least any one of a front side face and a rear side face opposite to the inner faces of at least any one of the front and rear blades of the lower slider of the box pin.

* * * * *